United States Patent [19]

Miyazaki et al.

[11] Patent Number: 4,724,912

[45] Date of Patent: Feb. 16, 1988

[54] MECHANISM FOR MOUNTING IMPACT TOOL

[75] Inventors: Takehide Miyazaki, Nara; Shogo Akechi, Sakai, both of Japan

[73] Assignee: Nippon Pneumatic Manufacturing Co., Ltd., Osaka, Japan

[21] Appl. No.: 881,833

[22] Filed: Jul. 2, 1986

[51] Int. Cl.[4] ..... E21B 3/00

[52] U.S. Cl. ..... 173/162 R; 173/162 H

[58] Field of Search ..... 173/162.1, 162.2, 134, 173/139; 299/64, 20; 248/20, 22

[56] References Cited

U.S. PATENT DOCUMENTS 3,889,762 6/1975 Sumner ..... 173/162.1

4,300,802 11/1981 Mitin et al. ..... 173/162.1

*Primary Examiner*—E. R. Kazenske

*Assistant Examiner*—Willmon Fridie, Jr.

*Attorney, Agent, or Firm*—Wenderoth, Lind & Ponack

[57] ABSTRACT

An improved mechanism for mounting an impact tool on the boom of a power shovel or the like. A mounting member is bonded to each side of the vibration insulating rubber member. The bonded surface between the rubber and the mounting member at at least one side of the rubber is oblique with respect to the axis of the impact tool. This reduces the shearing load to the vibration insulating rubbers, prolongs their life, and lessens the fear of the rubbers peeling off the mounting members.

3 Claims, 5 Drawing Figures

MECHANISM FOR MOUNTING IMPACT TOOL

BACKGROUND OF THE INVENTION

The present invention relates to a mechanism for mounting an impact tool on the boom of a power shovel or the like.

With a conventional mechanism of this type, an impact tool is mounted between a pair of mounting plates provided at tip of the boom of e.g. a power shovel, and the impact tool is coupled to the mounting plates through a plurality of vibration insulating rubber members to each side of which a mounting member is secured as by baking. With such a conventional mechanism, the bonded surfaces between each rubber member and the mounting members are parallel to the axis of the impact tool. Therefore, when the impact tool is pressed against an object to perform impact or other work, all the external force acting on the impact tool is applied to the vibration insulating rubber members as a shearing load. Thus, the rubber members have had a short working life and are apt to peel off the mounting members.

SUMMARY OF THE INVENTION

An object of the present invention is to provide an improved mechanism for mounting an impact tool which obviates the abovesaid shortcomings.

In accordance with the present invention, the bonded surface between each rubber member and the mounting member on at least one side of the rubber member is oblique with respect to the axis of the impact tool.

Since the rubber members are mounted obliquely with respect to the axis of the impact tool, when the chisel secured to the tip of the impact tool is pressed against an object to impact it, an upward reaction force is applied to the impact tool, so that the rubber members are compressed. This reduces the shearing load acting on the rubber members, thereby increasing the working life of the rubber members and lessening the force tending to peel the rubber members off the mounting members.

Other objects and features of the present invention will become apparent from the following description taken with reference to the accompanying drawings, in which:

DETAILED DESCRIPTION OF THE PREFERRED EMBODIMENT

Figure 1:
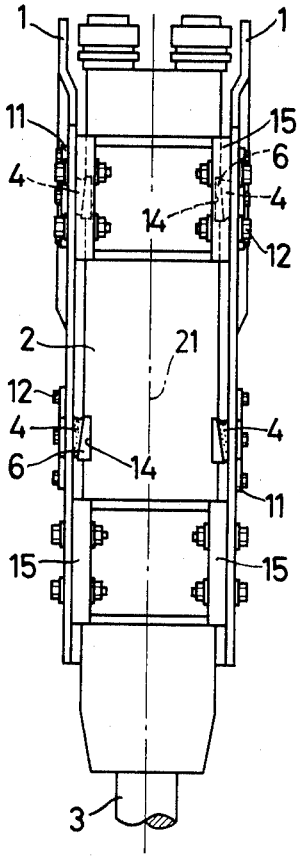
FIG. 1 is a front view of an impact tool mounted by means of a mechanism embodying the present invention.
Figure 2:
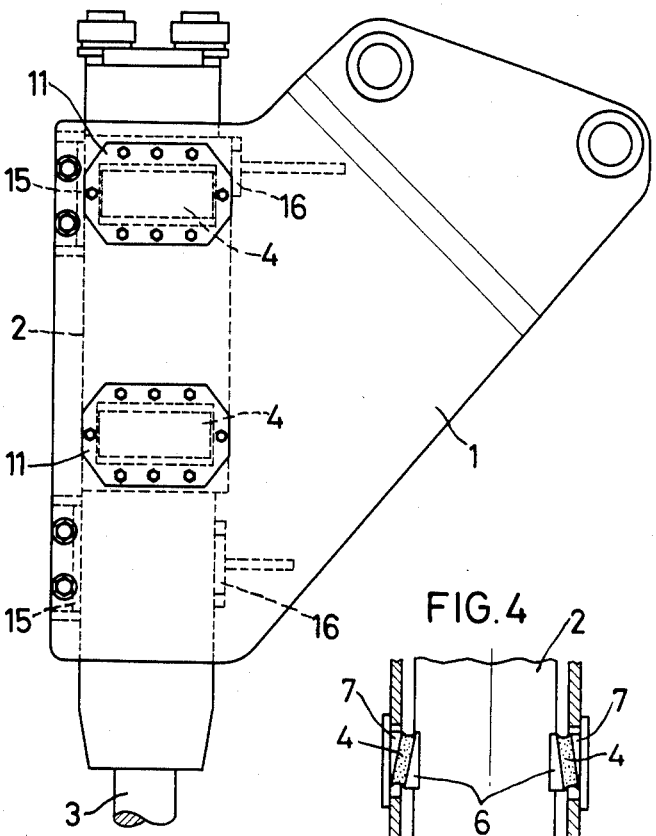
FIG. 2 is a side view of the same.

Referring to FIGS. 1 and 2, a pair of mounting plates 1 of steel are secured to the tip of a boom of a hydraulic power shovel or the like (not shown) with a predetermined distance therebetween. A chisel 3 is secured to the bottom of an impact tool 2 such as a hydraulic breaker, the impact tool having a longitudinal axis $2_1$.

Figure 3:
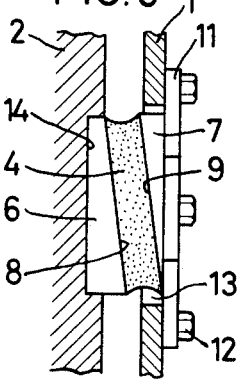
FIG. 3 is an enlarged vertical sectional view showing how a vibration insulating rubber member is mounted.

Numeral 4 designates a vibration insulating rubber member to the respective sides of which a mounting member 6 and 7 in the form of a steel plate are secured as by baking. As shown in FIG. 3, one mounting member 6 has its outer surface 8 bonded to the rubber member 4, the surface being oblique with respect to, i.e. at an angle to, the axis $2_1$ of the impact tool 2 so that the member 6 widens toward its bottom. The other mounting member 7 has its inner surface 9 bonded to the rubber member 4, the surface being oblique with respect to the axis $2_1$ of the impact tool 2 so that the member 7 narrows toward its bottom. The bonded surfaces 8 and 9 are parallel to each other.

A flange 11 integral with the mounting member 7 is secured to the mounting plate 1 by a plurality of bolts 12, as shown in FIG. 3. The mounting member 7 is received in an opening 13 formed in the mounting plate 1. The inner mounting plate 6 is engaged in a recess 14 formed in the impact tool 2. (FIG. 3)

In the embodiment of FIG. 1, two vibrating insulating rubber members 4 are arranged at each side of the impact tool 2 one above the other, and they are mounted by means of such mounting members 6 and 7 as shown in FIG. 3. Inside the mounting plates 1, there are provided guide members 15 and 16 at each side thereof and at two heights to prevent the impact tool 2 from moving back and forth.

In the embodiment of FIG. 1, the bonded surfaces 8 and 9 between the rubber member 4 and the mounting members 6 and 7 are all oblique so as to diverge from the axis 2, toward the bottom. This is true for both the upper and lower mounting members. In other words, all the rubber members 4 are mounted obliquely so as for their bottom end is directed outwardly. Thus, when the chisel 3 is pressed against an object to be worked and an upward reaction force is applied to the impact tool 2, the inner mounting members 6 will tend to move up with respect to the outer mounting members 7.

With this movement, the opposed pair of the bonded surfaces 8 and 9 will come near to each other and the rubber member 4 interposed therebetween will be compressed. This arrangement reduces the shearing load acting on the rubber member 4, and reduces the fear of the rubber member 4 being peeled off the mounting members 6 and 7. When the chisel 3 is moved away from the object and the mounting plates 1 are raised, the weight of the impact tool 2 will be applied to the mounting members 6, so that the rubber member 4 will be stretched. Since the load to the rubber members 4 is only the weight of the impact tool 2, there is no fear of the rubber member 4 peeling off the mounting members 6 and 7.

Figure 4:
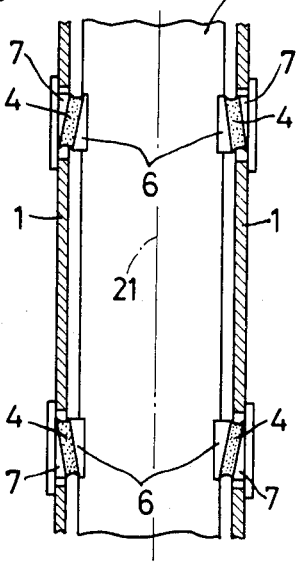
FIG. 4 is a partially cutaway vertical sectional front view showing the second embodiment.

FIG. 4 shows the second embodiment in which the upper rubber member 4 at each side are oblique with their bottom ends directed outwardly whereas the lower rubber member 4 at each side are oblique with their bottom ends directed inwardly. This arrangement assures that in whichever direction the impact tool 2 may move, either the upper or lower rubber members 4 are compressed to insulate the vibration.

Figure 5:
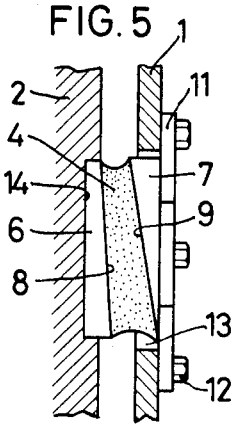
FIG. 5 is an enlarged vertical sectional view showing another embodiment.

FIG. 5 shows another embodiment in which the bonded surface 8 between the rubber member 4 and the inner mounting member 6 is oblique at a smaller angle with respect to the vertical axis $2_1$ than the bonded surface 9 between the rubber member 4 and the outer mounting member 7, so that the rubber member 4 has a thickness gradually increasing toward the bottom. This embodiment has a similar effect to that in the first and second embodiments.

One of the bonded surfaces 8 and 9 may be vertical, i.e. parallel to axis $2_1$.

What we claim:

1. In a mechanism for mounting an impact tool in the boom of a power shovel or the like, the boom having a pair of mounting plates at the tip thereof, the impact tool being mounted between the pair of the mounting plates through a plurality of vibration insulating rubber members each having opposite sides and having a mounting member bonded to each side thereof, the improvement comprising the surface at which said vibration insulating rubber member and said mounting member are bonded on at least one side of said vibration insulating rubber member being at an angle with respect to the longitudinal axis of said impact tool.

2. The mechanism as claimed in claim 1, wherein the surface at which said vibration insulating rubber member and said mounting member are bonded on one side of said vibration insulating rubber member is parallel to the axis of said impact tool and the surface at which said vibration insulating rubber member and said mounting member are bonded on the other side thereof is at an angle with respect to the axis of said impact tool.

3. The mechanism as claimed in claim 1, wherein the surfaces at which said vibration insulating rubber member and said mounting members are bonded on both sides of said vibration insulating rubber member are at an angle with respect to the axis of said impact tool.

* * * * *